US005475359A

United States Patent [19]

Hatayama et al.

[11] Patent Number: 5,475,359

[45] Date of Patent: Dec. 12, 1995

[54] VARIABLE RESISTOR

[75] Inventors: Masato Hatayama, Furukawa; Mitsuru Saitoh, Miyagi, both of Japan

[73] Assignee: Alps Electric Co., Ltd., Tokyo, Japan

[21] Appl. No.: 267,637

[22] Filed: Jun. 29, 1994

[30] Foreign Application Priority Data

Jul. 1, 1993 [JP] Japan ..... 5-189000

[51] Int. Cl.[6] ..... H01C 10/30

[52] U.S. Cl. ..... 338/160; 338/314; 252/512

[58] Field of Search ..... 338/118, 122, 338/128, 160, 204, 223, 224, 225, 314, 226, 310; 252/511, 512

[56] References Cited

U.S. PATENT DOCUMENTS 4,145,317 3/1979 Sado et al. ..... 252/512
4,300,115 1/1981 Ansell et al. ..... 338/314
4,639,391 1/1987 Charles ..... 428/210
4,877,554 10/1989 Honma et al. ..... 252/511
5,111,178 5/1992 Bosze ..... 338/160

*Primary Examiner*—Tu Hoang
*Attorney, Agent, or Firm*—Guy W. Shoup; Patrick T. Bever

[57] ABSTRACT

A variable resistor having a resistor body including a lower layer resistor in which at least carbon fibers and a carbon black are dispersed in a synthetic resin and an upper resistance layer not containing carbon fibers and in which at least a carbon black is dispersed in a synthetic resin, the upper layer being formed on the lower layer. Abrasion of a slider and the resistor body are suppressed to provide a long operation life, that is, a sliding movement life of the variable resistor.

10 Claims, 2 Drawing Sheets

VARIABLE RESISTOR

BACKGROUND OF THE INVENTION

1. Field of the Invention

The present invention concerns a variable resistor requiring a long operation life.

2. Description of the Prior Art

Variable resistors generally have a basic structure in which a slider is caused to slide on a resistor body, and an operation life as long as several millions of cycles is sometimes required depending on application uses. The present applicant has previously developed a variable resistor as disclosed in U.S. patent application Ser. No. 652,940. This resistor contains carbon fibers in a film of the resistor body in which the carbon fibers protrude out of the surface of the resistor film and a slide contact is adapted to slide on the carbon fibers. Since the carbon fibers are hard, they are scarcely abraded by the sliding movement of the slider. Accordingly, this resistor is free from drawbacks of resistor bodies in the prior art not containing the carbon fibers but containing only carbon black or graphite in which a resistance film is abraded due to the sliding movement of the slider to result in change of the resistance value of the resistor body, or sliding noises are caused due to presence of abraded powder at the boundary between the resistor body and the slider and, as a result, the proposed resistor can provide a long operation life.

However, in the variable resistor invented by the present applicant as described above, since the hardness of the carbon fibers is greater than that of the slider, it involves a problem that the slider is abraded to such an extent as capable of attaining the function no more and, as a result, gives a problem that no sufficient operation life can be provided for the market demand.

SUMMARY OF THE INVENTION

The foregoing problems in the prior art can be solved in accordance with the present invention by a variable resistor having a resistor body comprising a lower resistance layer in which at least carbon fibers and a carbon black are dispersed in a synthetic resin and an upper resistance layer containing no carbon fibers and at least a carbon black dispersed in a synthetic resin are stacked to each other, wherein the film thickness of the lower resistance layer not containing the carbon fibers is from 0.75 to 1.25 times the diameter of the carbon fiber and the film thickness of the upper resistance layer is from 0.5 to 1 times the film thickness of the lower resistance layer.

In the present invention, since the film thickness of the lower resistance layer is made 0.5 to 1.5 times, preferably, 0.75 to 1.25 times the diameter of the carbon fiber, the carbon fibers are disposed such that they are laid down in the resistance layer, namely, the circumferential surfaces of elongate cylindrical carbon fibers protrude out of the surface of the resistance layer or, in other words, such that the end faces of the carbon fibers are not protruded. Since the edge at the end face of the carbon fiber is sharp, this abraded the slider as if it were scraped and, on the other hand, the circumferential surface of the fiber, being a smooth surface, does not scrape the slider but causes relatively moderate abrasion. With a such a constitution, abrasion of the slider can be suppressed to a relatively low extent. Furthermore, since the upper resistance layer is disposed and the film thickness thereof is made from 0.5 to 1 times the film thickness of the lower resistance layer, the amount of the carbon fibers protruding from the entire resistance layers including the upper resistance layer is reduced, in other words, the surface unevenness of the resistance layer is reduced, and a layer not containing carbon fibers but containing a carbon black or the like is formed to an appropriate thickness on the carbon fiber, so that abrasion of the slider can be reduced. On the other hand, since abrasion of the resistance layer caused by the slider remains within a range of abrasion mainly of the resistance layer on the carbon fibers, it is possible to extremely reduce the change of the resistance value for entire resistor body and sliding noises, so that a long operation life can be obtained.

BRIEF DESCRIPTION OF THE ACCOMPANYING DRAWINGS

DESCRIPTION OF THE PREFERRED EMBODIMENT

Figure 1:
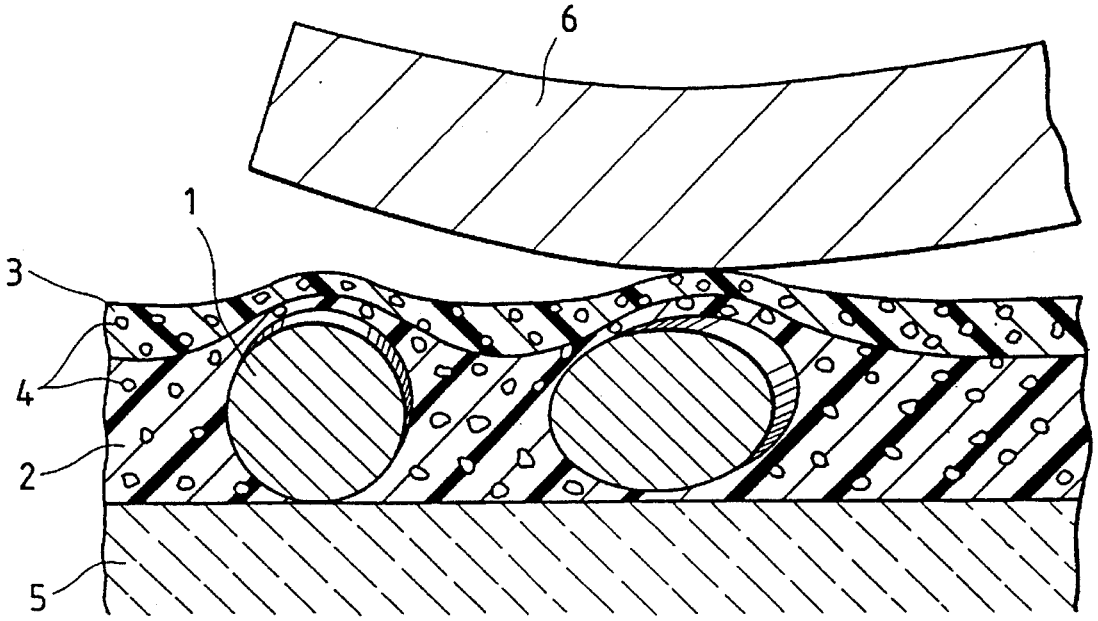
FIG. 1 is a cross sectional view of a resistor portion in a variable resistor according to the present invention.

As shown in FIG. 1, a resistor body of a variable resistor according to the present invention comprises a lower resistance layer 2 containing carbon fibers 1 and an upper resistance layer 3 not containing carbon fibers. There are also shown carbon black 4, substrate 5 and slider 6.

In the present invention, the lower resistance layer and the upper resistance layer are formed respectively by printing formulated resistance paste on an insulative substrate by screen printing.

A first resistance paste for the lower resistance layer comprises a binder resin made of a thermosetting resin, carbon fibers, a carbon black, a graphite and a solvent, as well as an adequate printability modifier kneaded together. Graphite may be saved depending on application uses.

As the thermosetting resin, there can be used, for example, phenol formaldehyde resin, xylene modified phenol resin, epoxy resin, polyimide resin, melamine resin, acryl resin, acrylate resin and furfuryl resin with no particular restriction only to them, so long as they can be formed into a varnish. Among the resins described above, the polyimide resin can be said to be an effective material in view of the operation life since it is confirmed to endure the effect of heat generated upon sliding movement.

As the carbon fiber, short fibers having a diameter of 5 to 40μ and a length of 5 to 100 μm such as mild carbon fiber or chopped carbon fiber can be used. Those short fibers having a diameter of 6 to 20 μm and a length of 10 to 50 μm are particularly suitable. If the diameter or the length of the carbon fiber is less than the above-specified range, since area of contact with the thermosetting resin in the resistance layer is reduced to weaken the bonding force, the carbon fibers are liable to be scraped by the sliding movement of the slider, failing to attain a sufficient improvement for the operation life. On the contrary, if the diameter or the length of the carbon fiber is greater than the above-specified range, since the carbon fiber can not easily pass through the mesh of a screen used upon screen printing to remarkably lower the printability and disturbance is caused in the characteristic of the changes of the resistance value.

As the carbon black, acetylene black, furnace black, channel black or the like can be used among which acetylene black can be said to be a particularly effective material since it has merit such as having a developed branched structure, capable of providing by itself a reinforcing effect to some extent and reducing the aging change of the resistance value of the resistor body.

As the graphite, flaky or slurry graphite can be used. Graphite is used with a purpose of lowering the resistance value of the resistor body. Presence of graphite provides an advantageous effect capable of preventing an undesired phenomenon that the resistance value of the resistor body formed by printing varies as the number of printing cycles is increased due to kneading of the paste between a screen and a squeeze upon printing of the paste to cause change at the inside of the paste so that it is desirable to blend an appropriate amount of graphite but this is not a condition essential to the present invention.

Any of solvents capable of dissolving the thermosetting resins described above can be used and one or more of glycol, ester or ether type solvents can be used selectively.

In addition, appropriate modifiers may be used in order to control the printability.

Each of the materials is weighed for a required amount and then kneaded in a dispersion/mixing device such as a ball mill or three-roll mill to fabricate a first resistance paste.

In the first resistance paste, the amount of the carbon fibers is from 3 vol % to 20 vol % based on the amount of the solid content in the paste (carbon fibers, as well as solid content of binder resin after curing. If the amount of the carbon fibers is less than 3 vol %, reinforcement for the resistance layer is insufficient to cause remarkable abrasion for the resistance layer. On the other hand, if the amount of the carbon fibers is greater than 20 vol %, a possibility that the carbon fibers are piled is increased by which the sharp end faces of the carbon fibers protrude out of the resistance layer to promote abrasion of the slider. If the amount of the carbon fibers is from 6 to 18 vol %, the foregoing problem is not caused at all irrespective of scattering of the factors in view of fabrication. The amount of the carbon black is from 5 to 25 vol % based on the solid content of the paste. Desirably it is from 10 to 20 vol %. If the amount of the carbon black is insufficient, the contact resistance between the slider and the resistance layer is increased. On the other hand, if the amount of the carbon black is excessive, the coating film of the resistance layer is weakened.

As the material for the second resistance paste for use in the upper resistance layer, the material for the first resistance paste described above from which carbon fibers are removed is used and the manufacturing method therefor is substantially identical with that for the first resistance paste. The blending ratio for each of the materials is Just equal with or somewhat changed from the blending ratio for the materials of the first resistance paste removed with the carbon fibers.

The resistance pastes prepared as described above are printed on an insulative substrate by a known screen printing method. At first, electrodes positioned on both ends of the resistance layer are formed on the insulative substrate by printing and curing an electroconductive paste containing known silver or the like. Then, the first resistance paste is printed, dried and then cured to form a lower resistance layer. Then, the second resistance paste is printed, dried and cured to form the upper resistance layer. As the screen used for the printing, a screen having 325 to 165 mesh is used depending on the film thickness of the resistance layer after curing. Referring to the drying and curing steps after printing, in addition to the sequence described above, the curing step after printing the first resistance paste may be saved and curing may be applied only after printing the second resistance paste.

The resistance layer, that is, the resistor body is formed in a horse-shoe shape or an elongate shape, in which a slider is disposed rotatably to the substrate in the former while the slider is mounted slidably to the substrate in the latter, thereby obtaining a rotary or sliding type variable resistor.

As the material for the slider, noble metal capable of keeping a good contact with the resistor body even after long time sliding movement is used and, specifically, nickel silver having gold or silver plating applied on the surface, or alloys composed of palladium, silver, platinum or gold can be used. In particular, if there is a worry of surface oxidation at a high temperature, use of a noble metal alloy is desirable for maintaining a stable state of contact.

EXAMPLE 1

| | |
|---|---|
| Polyimide resin | 200 g |
| Mild carbon fiber (diameter: 8 μm length: 30 μm) | 60 g |
| Carbon black (acetylene black) | 59 g |
| Methyltriglyme | 220 g |

Each of the ingredients described above was blended and mixed and dispersed by a three-roll mill to prepare a first resistance paste. When the resistance paste was used, the amount of the carbon fiber is 15.8% and the amount of the carbon black was 15.2% in the resistance layer (solid content).

| | |
|---|---|
| Polyimide resin | 180 g |
| Carbon black (acetylene black) | 53 g |
| Methyltriglyme | 220 g |

Each of the ingredients was blended and mixed and dispersed by a three-roll mill to prepare the second resistance paste.

Then, the first resistance paste was printed by using an adequate mesh screen on an insulative substrate made of ceramics having electrodes previously formed thereon, and then dried to form a lower resistance layer. Subsequently, the second resistance paste was printed on the lower resistance layer, dried and then cured to fabricate 25 kinds of resistor bodies such that the film thickness at a portion where the carbon fibers are not present in the lower resistance layer and the film thickness of the upper resistance layer provide combinations as shown in Table 1. Drying conditions were at 200° C. for 10 min and curing conditions were at 360° C. for 60 min. Numerical values in the matrix of Table 1 show the ratio of the film thickness of the upper resistance layer to the film thickness of the portion of the lower resistance layer in which no carbon fibers are present. The numerical values below the values for the film thickness of the lower resistance layer show the ratio of the film thickness relative to the diameter of the carbon fiber.

TABLE 1

| B | A: 4 μm 0.5 | 6 μm 0.75 | 8 μm 1.0 | 10 μm 1.25 | 12 μm 1.5 |
|---|---|---|---|---|---|
| 2 μm | 0.5 | 0.33 | 0.25 | 0.25 | 0.17 |
| 4 μm | 1.0 | 0.67 | 0.5 | 0.4 | 0.33 |
| 6 μm | 1.5 | 1.0 | 0.75 | 0.6 | 0.5 |
| 8 μm | 2.0 | 1.33 | 1.0 | 0.8 | 0.67 |
| 10 μm | 2.5 | 1.67 | 1.25 | 1.0 | 0.83 |

Figure 2:
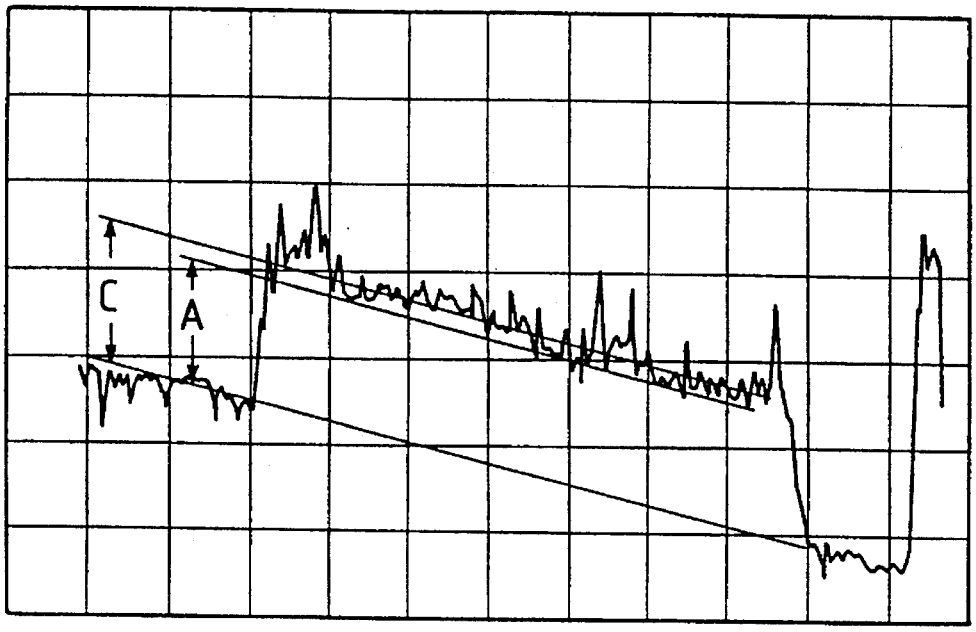
FIG. 2 is a graph showing data obtained by a surface roughness gage showing the surface shape of a lower resistance layer.
Figure 3:
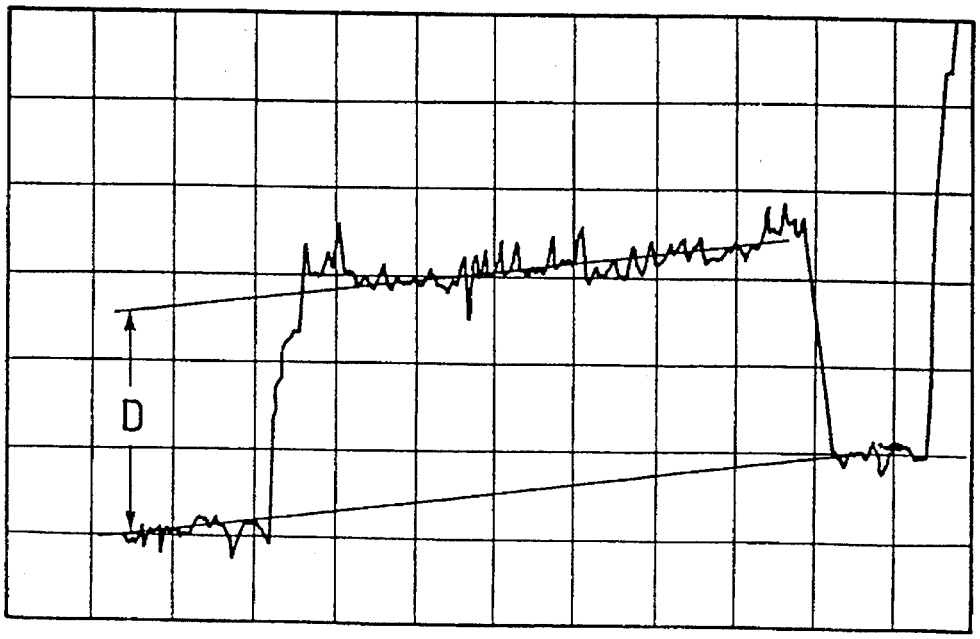
FIG. 3 is a view showing data obtained by a surface roughness gage showing the surface shape of a resistor body after forming the upper resistance layer.

A: Film thickness of lower resistance layer
B: Film thickness of upper resistance layer The film thickness for each of the resistance layers was measured by a surface roughness gauge. At first, the surface shape was measured by a surface roughness gauge as shown in FIG. 2 in a stage of forming the lower resistance layer, and the film thickness A at the position where no carbon fibers are present, that is, at the recess of the surface unevenness was determined as the film thickness for the lower resistance layer, and the entire average film thickness C including the uneven portion was determined to form the upper resistance layer. Subsequently, as shown in FIG. 3, the average film thickness was determined, from which the former average film thickness C was subtracted to be the film thickness B for the upper resistance layer. Further, samples cut along the cross section of the resistor was observed by a microscope to confirm the film thickness again, it was aligned with the film thickness the measuring method in the former at an order of 10% error.

The area resistance value of the first resistor paste and the second resistance paste at the film thickness of 10 μm were 1.05 kΩ/□ and 1.48 kΩ/□, respectively, under the same conditions as the drying conditions and the curing conditions. The area resistance values for 25 kinds of the samples were as shown in Table 2.

TABLE 2

| B | A: 4 μm 0.5 | 6 μm 0.75 | 8 μm 1.0 | 10 μm 1.25 | 12 μm 1.5 |
|---|---|---|---|---|---|
| 2 μm | 2.79 | 1.89 | 1.39 | 1.11 | 0.90 |
| 4 μm | 2.67 | 1.80 | 1.35 | 1.07 | 0.90 |
| 6 μm | 1.48 | 1.31 | 1.11 | 0.94 | 0.82 |
| 8 μm | 1.31 | 1.15 | 0.94 | 0.86 | 0.78 |
| 10 μm | 1.23 | 1.03 | 0.90 | 0.82 | 0.74 |

(unit: k Ω/□)
A: Film thickness of lower resistance layer
B: Film thickness of upper resistance layer

COMPARATIVE EXAMPLE

As a comparative example, a resistor body of 10 μm thickness was fabricated using the first resistance paste as described above and in the same manner as in the previous example. This is identical with the resistor body in the previous example having a film thickness of the lower resistance layer of 10μ, with no upper resistance layer. The resistor body had an area resistance value of 1.05 Ω/□.

An operation life test, that is, sliding movement life test was conducted for 25 kinds of the samples in the example and the samples in the comparative example. In this test, the slider was made of a Pd-Ag-Pt-Cu-Zn-Ni hexanary alloy having a contact of 0.3 mm thickness and 0.5 mm width, and provided an entire pressure of contact of 8 g. The slider was caused to slide over the entire section between both of the terminal ends of the resistor body. After sliding movement for 40 millions of cycles, in the test, abrasion state of the slider, and increase of a localized contact resistance were monitored and then they were collectively evaluated. The abrasion state of the slider was measured microscopically for the abrasion amount of the contact portion. The centralized contact resistance was measured by a method in accordance with JIS C5261.

Table 3 shows a result of measurement for the abrasion amount of the slider after the test. In the sample of the comparative example, the contact portion of the slider was completely abraded to deplete the contact portion. Table 4 shows a result for the measurement of the localized contact resistance after testing. The measured value was extremely instable for the sample of the comparative example since the contact portion of the slider was depleted.

TABLE 3

| B | A: 4 μm 0.5 | 6 μm 0.75 | 8 μm 1.0 | 10 μm 1.25 | 12 μm 1.5 |
|---|---|---|---|---|---|
| 2 μm | 150 | 160 | 180 | 260 | 380 |
| 4 μm | 80 | 80 | 90 | 160 | 310 |
| 6 μm | 30 | 60 | 60 | 90 | 180 |
| 8 μm | 30 | 40 | 60 | 60 | 140 |
| 10 μm | 30 | 30 | 40 | 60 | 90 |

(unit: μm)
A: Film thickness of lower resistance layer
B: Film thickness of upper resistance layer

TABLE 4

| B | A: 4 μm 0.5 | 6 μm 0.75 | 8 μm 1.0 | 10 μm 1.25 | 12 μm 1.5 |
|---|---|---|---|---|---|
| 2 μm | 52 | 26 | 22 | 611 | 2200 |
| 4 μm | 64 | 34 | 26 | 22 | 800 |
| 6 μm | 264 | 60 | 34 | 32 | 22 |
| 8 μm | 681 | 80 | 48 | 46 | 34 |
| 10 μm | 2300 | 536 | 160 | 125 | 90 |

(unit: %)
A: Film thickness of lower resistance layer
B: Film thickness of upper resistance layer Table 5 shows a result of overall evaluation of the sliding movement life in view of the abrasion state and increase of the localized contact resistance of the slider. From the result, it is judged that the range surrounded with a fat line shows a satisfactory sliding movement life. In the table, evaluation is shown by symbols, namely, "x" for not suitable to practical use, "◎" for excellent performance, "o" for performance superior to the prior art and capable of being put to practical use.

TABLE 5

| B \ A | 4 μm 0.5 | 6 μm 0.75 | 8 μm 1.0 | 10 μm 1.25 | 12 μm 1.5 |
|---|---|---|---|---|---|
| 2 μm | ○ | ○ | ○ | X | X |
| 4 μm | X | ◎ | ◎ | ○ | X |
| 6 μm | X | ◎ | ◎ | ◎ | ○ |
| 8 μm | | ◎ | ◎ | ◎ | ○ |
| 10 μm | X | X | ○ | ○ | ○ |

TABLE 5-continued

| | | | | | |
|---|---|---|---|---|---|
| A | 4 μm | 6 μm | 8 μm | 10 μm | 12 μm |
| B | 0.5 | 0.75 | 1.0 | 1.25 | 1.5 |

A: Film thickness of lower resistance layer
B: Film thickness of upper resistance layer As an overall reference to Tables 1 and 5, resistor bodies having the film thickness of the lower resistance layer within a range from 0.5 to 1.5 times the diameter of the carbon fiber and the ratio of the film thickness of the upper resistance layer to the lower resistance layer is within a range from 0.5 to 1.0 show excellent performance and are practical as compared with the existent resistor body comprising only one resistance layer containing carbon fibers and more excellent performance can be obtained for resistor bodies having the film thickness of the lower resistance layer within a range from 0.75 to 1.25 times the diameter of the carbon fibers and the ratio of the film thickness of the upper resistance layer to the film thickness of the lower resistance layer within range from 0.5 to 1.0.

As has been described above, according to the present invention, since abrasion of the slider and the abrasion of the resistor body can be suppressed, it is possible to provide a variable resistor having a long sliding movement life, that is, an operation life.

What is claimed is:

1. A variable resistor comprising:

a resistor body including:

a lower resistance layer in which at least carbon fibers and carbon black are dispersed in a synthetic resin; and an upper resistance layer not containing carbon fibers and in which at least carbon black is dispersed in a synthetic resin, said upper resistance layer being formed on said lower resistance layer; and a slider disposed to slide on the upper resistance layer of the resistor body.

2. A variable resistor having a resistor body comprising:

a lower resistance layer in which at least carbon fibers and carbon black are dispersed in a synthetic resin; and an upper resistance layer not containing carbon fibers and in which at least carbon black is dispersed in a synthetic resin, said upper resistance layer being formed on said lower resistance layer;

wherein a thickness of the lower resistance layer is between 0.5 and 1.5 times a diameter of the carbon fibers.

3. A variable resistor having a resistor body comprising:

a lower resistance layer in which at least carbon fibers and carbon black are dispersed in a synthetic resin; and an upper resistance layer not containing carbon fibers and in which at least carbon black is dispersed in a synthetic resin, said upper resistance layer being formed on said lower resistance layer;

wherein a thickness of the lower resistance layer is between 0.75 and 1.25 times a diameter of the carbon fibers.

4. A variable resistor as defined in claim 2, wherein a film thickness of the upper resistance layer is between 0.5 and 1 times a film thickness of the lower resistance layer.

5. A variable resistor as defined in claim 3, wherein a film thickness of the upper resistance layer is between 0.5 and 1 times a film thickness of the lower resistance layer.

6. A variable resistor as defined in claim 2, wherein the diameter of the carbon fibers is between 6 and μm and a length between 10 and 50 μm.

7. A variable resistor as defined in claim 1, wherein a thickness of the lower resistance layer is between 0.5 and 1.5 times a diameter of the carbon fibers.

8. A variable resistor as defined in claim 7, wherein a film thickness of the upper resistance layer is between 0.5 and 1 times a film thickness of the lower resistance layer.

9. A variable resistor as defined in claim 8, wherein the diameter of the carbon fibers is between 6 and 20 μm and a length between 10 and 50 μm.

10. A variable resistor as defined in claim 3, wherein the diameter of the carbon fibers is between 6 and 20 μm and a length between 10 and 50 μm.

* * * * *